US007252529B2

(12) United States Patent
Yang et al.

(10) Patent No.: US 7,252,529 B2
(45) Date of Patent: Aug. 7, 2007

(54) CHIP CARD RETAINING MECHANISM

(75) Inventors: Qing Yang, Shenzhen (CN); Chia-Hua Chen, Tu-cheng (TW)

(73) Assignees: ShenZhen FuTaiHong Precision Industrial Co., Ltd., Shenzhen, Guangdong Province (CN); Sutech Trading Limited, Tortola (VG)

( * ) Notice: Subject to any disclaimer, the term of this patent is extended or adjusted under 35 U.S.C. 154(b) by 0 days.

(21) Appl. No.: 11/484,395

(22) Filed: Jul. 11, 2006

(65) Prior Publication Data

US 2007/0128914 A1 Jun. 7, 2007

(30) Foreign Application Priority Data

Dec. 2, 2005 (CN) ..... 2005 1 0102027

(51) Int. Cl.
*H01R 13/62* (2006.01)

(52) U.S. Cl. ..... 439/327

(58) Field of Classification Search ..... 439/326, 439/327, 328, 630, 357
See application file for complete search history.

(56) References Cited

U.S. PATENT DOCUMENTS 5,813,878 A * 9/1998 Kuwata et al. ..... 439/326
6,106,317 A * 8/2000 Michaelis et al. ..... 439/326
6,174,188 B1 * 1/2001 Martucci ..... 439/326
6,175,505 B1 * 1/2001 Cheng et al. ..... 361/752
6,210,193 B1 * 4/2001 Ito et al. ..... 439/326
6,471,550 B2 * 10/2002 Maiterth et al. ..... 439/631
6,764,327 B2 * 7/2004 Yu ..... 439/188
6,881,086 B2 * 4/2005 Ohashi ..... 439/326
6,890,203 B2 * 5/2005 Matsunaga et al. ..... 439/331
7,014,508 B2 * 3/2006 Tsai ..... 439/630

* cited by examiner

*Primary Examiner*—Tulsidas C. Patel
*Assistant Examiner*—Harshad C Patel
(74) *Attorney, Agent, or Firm*—Jeffrey T. Knapp

(57) ABSTRACT

A chip card retaining mechanism for retaining a chip card (40) mounted in an electronic device is provided. The electronic device includes a housing (10) having a battery compartment (14) defined therein. The chip card retaining mechanism includes a locking member (30). The locking member is securely mounted on the receiving portion. The locking member and a surface of the housing cooperatively form a receiving cavity therebetween for receiving the chip card therein and locking the chip card in the receiving cavity. A first end of the locking member and a surface of the housing cooperatively form an opening for inserting the chip card.

18 Claims, 5 Drawing Sheets

CHIP CARD RETAINING MECHANISM

TECHNICAL FIELD

The present invention generally relates to chip card retaining mechanisms and, more particularly, to a chip card retaining mechanism for seating a chip card in an electronic device such as a mobile phone.

BACKGROUND

Nowadays, electronic devices such as mobile phones are widely used and bring convenience to our lives, as such, electronic devices have become a part of modern life. Every electronic device has a chip card such as a SIM (subscriber identification module) card for carrying information necessary for operating the mobile phone. The chip card may also contain personal information for the subscriber, for example, a listing of frequently used telephone numbers. However, it is necessary to provide a chip card retaining mechanism to hold the chip card in the electronic device.

Referring to FIG. 6, a typical chip card retaining mechanism used in a mobile phone is as follows. The chip card retaining mechanism includes a mounting base 52 and a locking element 54. A receiving groove 520 is defined in the mounting base 52 for receiving a chip card. A connector 50 is disposed in the receiving groove 520. The locking element 54 is mounted on the mounting base 52 and located adjacent to the receiving groove 520. The locking element 54 can move in a direction shown by an arrow. In assembly, the locking element 54 is pushed away from the receiving groove 520 to completely expose the receiving groove 520. A SIM card is received in the receiving groove 520, and the locking element 54 is pushed toward the receiving groove 520 to cover a portion of the receiving groove 520 so that the SIM card cannot be removed from the receiving groove 520.

Although the locking element 54 can be easily moved to assembly the SIM card. However, when a mobile phone inadvertently falls to a ground, an impact which results from an outer force can make the locking element 54 remove from the receiving groove 520, which results in an ineffective electrical connection between the SIM card and the connector 50. At worst, the SIM card may become separated from the receiving groove 520, which badly affects a stability of the mobile phone.

What is needed, therefore, is a chip card retaining mechanism which overcomes the above-described shortcomings.

SUMMARY

A chip card retaining mechanism for mounting a chip card in an electronic device is provided. In one embodiment thereof, the electronic device includes a housing having a battery compartment defined therein. The chip card retaining mechanism includes a locking member. The locking member is securely mounted on the receiving portion. The locking member and a surface of the housing cooperatively form a receiving cavity therebetween for receiving the chip card therein and locking the chip card in the receiving cavity. A first end of the locking member and a surface of the housing cooperatively form an opening for inserting the chip card.

Other advantages and novel features of the preferred embodiments of the present hinge system and its applications will become more apparent from the following detailed description when taken in conjunction with the accompanying drawings.

BRIEF DESCRIPTION OF THE DRAWINGS

Many aspects of the present chip card retaining mechanisms and their applications can be better understood with reference to the following drawings. The components in the drawings are not necessarily drawn to scale, the emphasis instead being placed upon clearly illustrating the principles of the chip card retaining mechanisms. Moreover, in the drawings, like reference numerals designate corresponding parts throughout the several views.

DETAILED DESCRIPTION OF PREFERRED EMBODIMENTS

Figure 1:
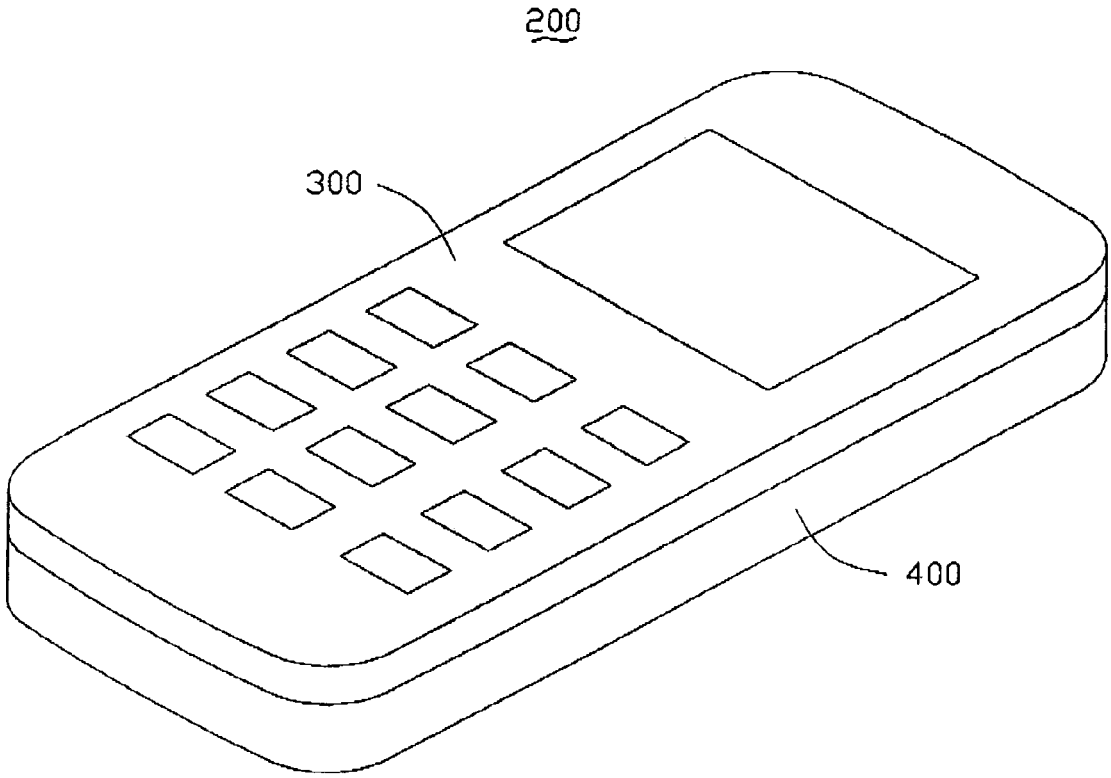
FIG. 1 is an isometric view of an electronic device, which employs a chip card retaining mechanism in accordance with a first preferred embodiment.
Figure 2:
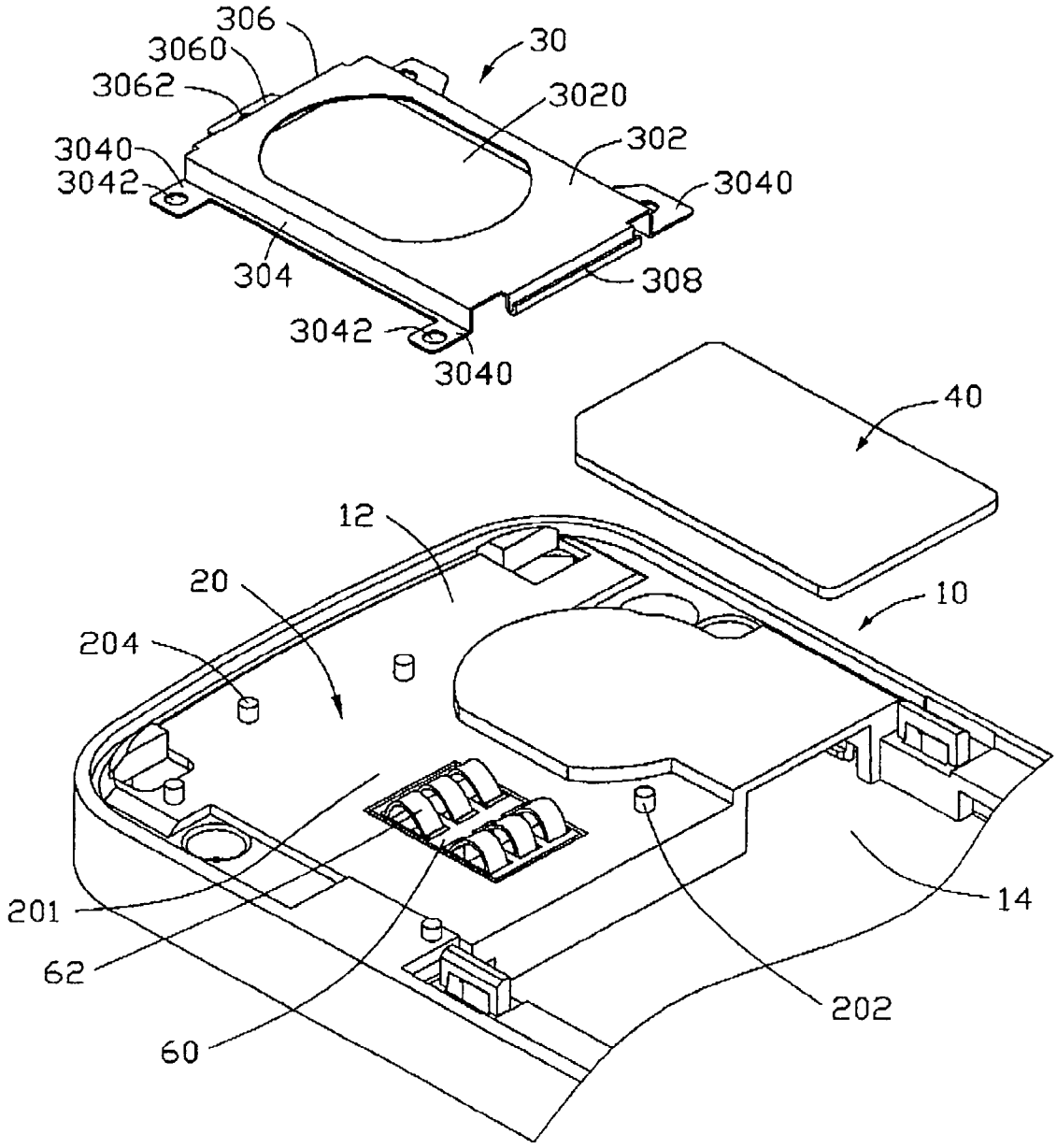
FIG. 2 is an exploded, isometric view of the chip card retaining mechanism of the chip card retaining mechanism of the preferred embodiment.

A chip card retaining mechanism is adapted for retaining a chip card in an electronic device such that the chip card is electrically connected with a connector in the electronic device. Referring to FIG. 1, the chip card retaining mechanism is applied to an exemplary mobile phone 200, which includes a front cover 300, a housing 10, and a rear cover 400. The front cover 300 and the rear cover 400 cooperatively define an enclosed space. The housing 10 is mounted in the enclosed space. Referring to FIG. 2, in order to identify the used mobile phone, when communicating, a chip card 40, such as a subscriber identification module, also called SIM card, is provided. Referring to FIG. 2, in the figure parts of the housing 10 have been omitted for reasons of clarity. The housing 10 has a battery compartment 14 defined adjacent to a partition 12 of the housing 10. The battery compartment 14 is for receiving a battery (not shown).

The chip card retaining mechanism includes a receiving portion 20, and a locking member 30. The receiving portion 20 is configured for receiving the chip card 40.

The receiving portion 20 is substantially rectangular, and defined by a bottom surface 201 of the partition 12, four first protruding posts 202, and a second protruding post 204 on the partition 12. The first protruding posts 202 are symmetrically located at four corners of the receiving portion 20, in which two protruding posts 202 are positioned adjacent to the battery compartment 14 and two protruding post 202 are positioned away from the battery compartment 14. The second protruding post 202 is located adjacent to an edge of the partition 20 and away from the battery compartment 14.

The chip card 40 carries information that is necessary for operating the telephone and personal information of the owner and may be an integrated circuit card. The chip card 40 is electrically connected to a printed circuit board (PCB, not shown) by a connector 60. The connector 60 is secured in the housing 10 and disposed in a middle of the receiving portion 20. The connector 60 has a plurality of elastic contacts 62. The elastic contacts 62 protrude from the bottom surface 201 of the partition 12. The chip card 40 is mounted in the receiving portion 20 in contact with the elastic contacts 62 of the connector 60.

Figure 4:
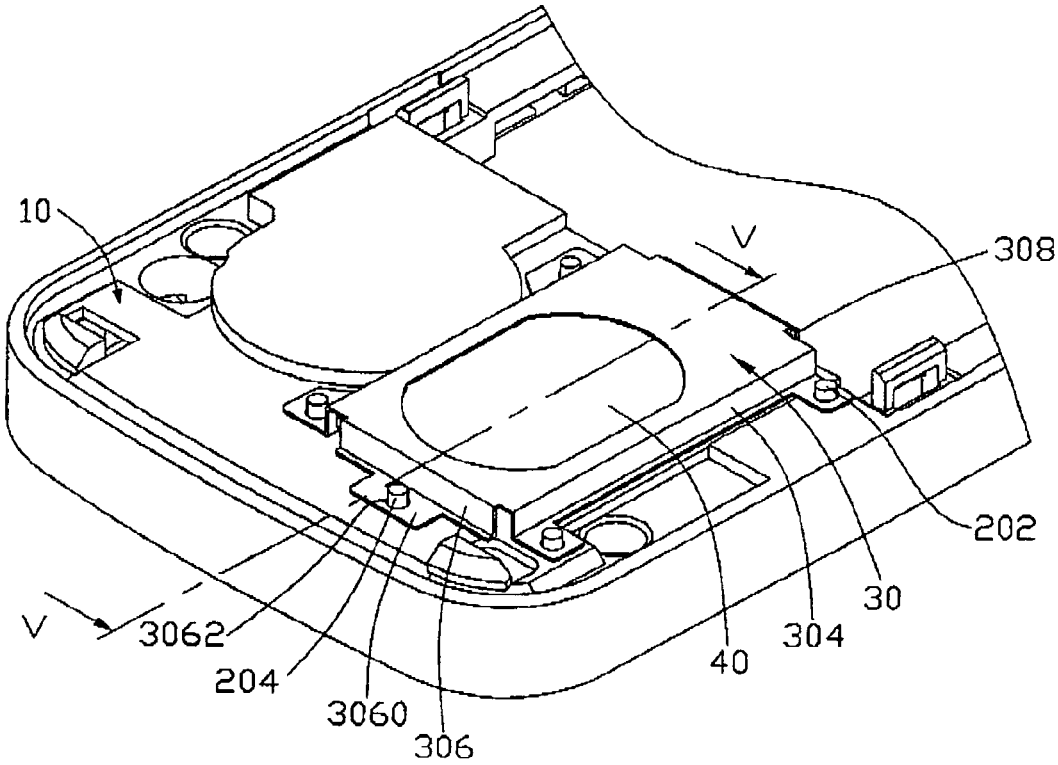
FIG. 4 is an assembled, isometric view of the chip card retaining mechanism of FIG. 2, showing a second position of the chip card.

Referring also to FIG. 4, the locking member 30 is substantially rectangular, and includes a rectangular body 302. The locking member 30 has an aperture 3020 defined in the rectangular body 302. Two opposite first sidewalls 304 extend downwards from two long sides of the rectangular body 302. A distance between the first sidewalls 304 is equal to a width of the chip card 40. Each end of each first sidewall 304 is provided an ear 3040 horizontally extending therefrom. Each ear 3040 defines a first mounting hole 3042, for engaging around a respective first protruding post 202. A second sidewall 306 extends downwards from one short side of the rectangular body 302. A bent portion 3060 horizontally extends from a middle of the second sidewall 306. The bent flake 3060 defines a second mounting hole 3062, for engaging around the second protruding post 204. A third sidewall 308 vertically extends from another short side of the rectangular body 302. The third sidewall 308 is hook shaped. A height of each first sidewall 304 is same as that of the second sidewall 306, and larger than that of the third sidewall 308. A height of the third sidewall 308 is slightly larger than a thickness of the chip card 40. The ears 3040 and the bent portion 3060 are aligned in parallel to the rectangular body 302.

Figure 3:
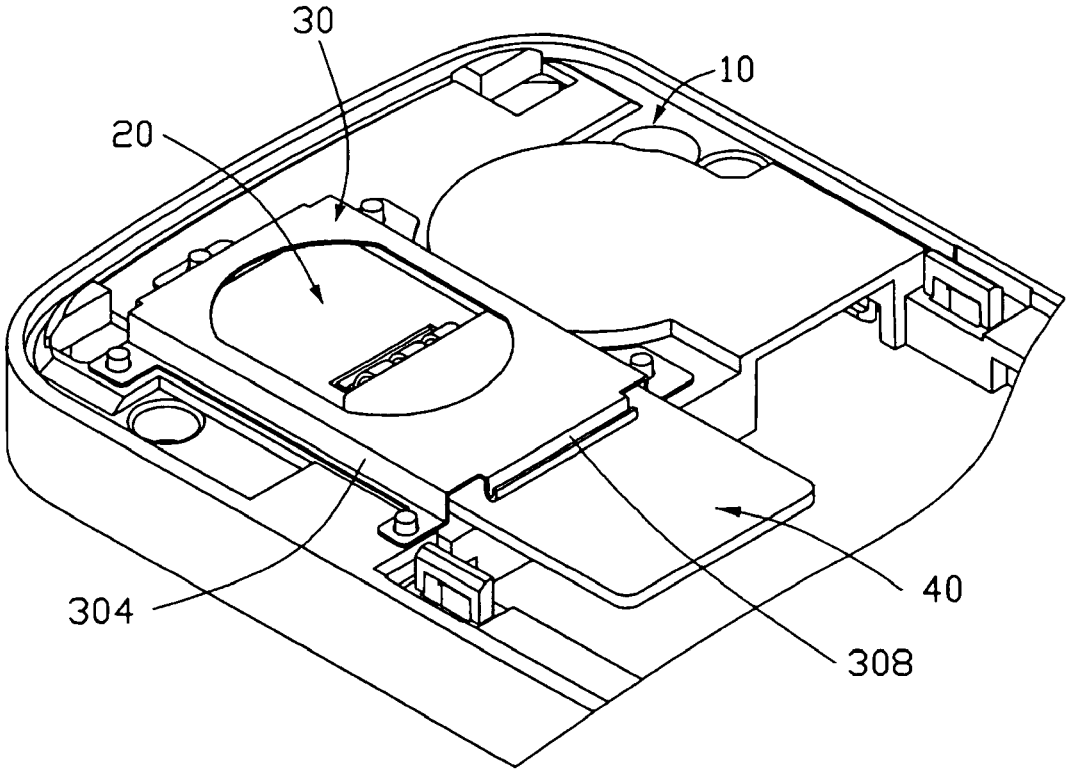
FIG. 3 is an assembled, isometric view of the chip card retaining mechanism of FIG. 2, showing a first position of the chip card.
Figure 5:
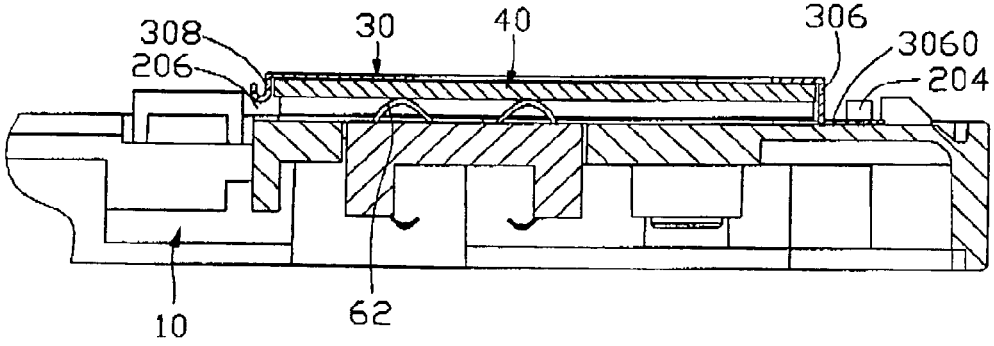
FIG. 5 is an cross-sectional view taken along V-V line of FIG. 3, showing a first position of the chip card.
Figure 6:
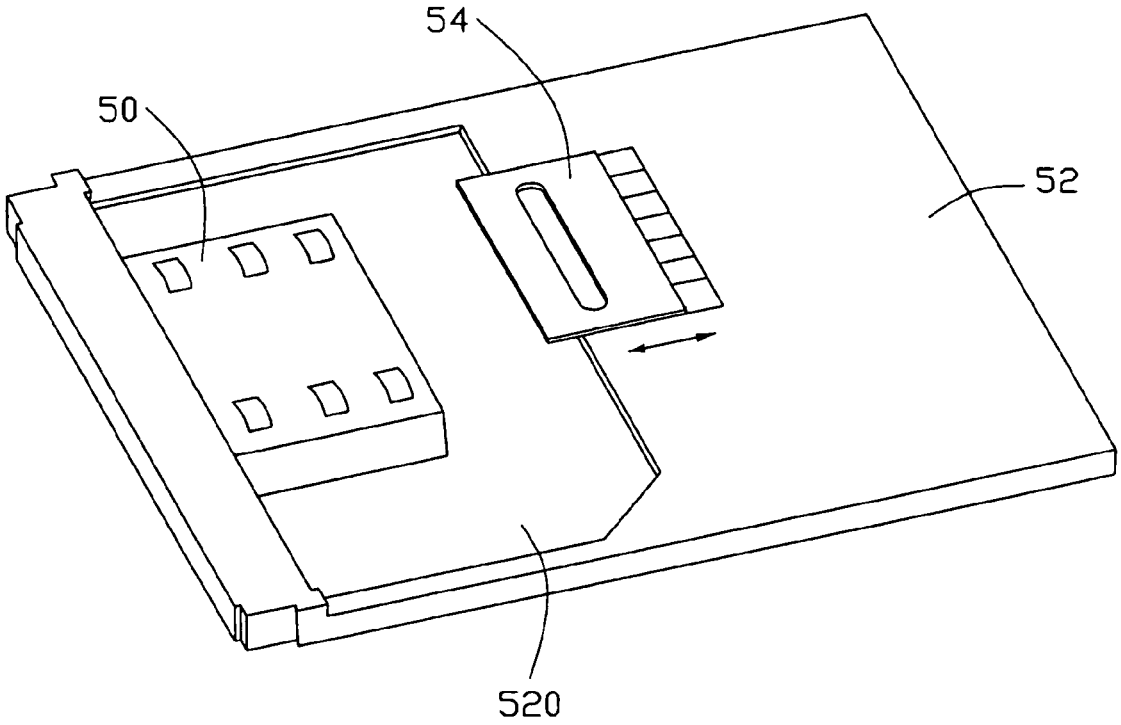
FIG. 6 (BACKGROUND ART)
FIG. 6 is an exploded, isometric view of a typical chip card retaining mechanism.

Referring to FIGS. 3 and 5 in assembly the locking member 30 is mounted on the partition 12 of the housing 10 and positioned on the receiving portion 20. The first mounting holes 3042 and the second mounting hole 3062 are respectively engaged around the first protruding posts 202 and the second protruding post 204, and are secured with each other by welding/melding. In this state, the third sidewall 308 is adjacent to the battery compartment 14. A clearance is defined between the third sidewall 308 and the bottom surface 201 of the receiving portion 20 and slightly greater than a thickness of the chip card 40, thus forming an opening 206 for inserting the chip card 40 into.

When mounting the chip card 40, the chip card 40 is placed to align with the opening 206, and pushed into the receiving portion 20 via the opening 206 and slides in the receiving portion 20 under the guidance of the first sidewalls 304. When the chip card 40 is completely received in the receiving portion 20, the chip card 40 stops moving. Then, the chip card 40 is pushed upward by the elastic contacts 62 of the connector 60, and thus the chip card 40 is fittingly held between the rectangular body 302 of the locking member 30 and the elastic contacts 62 of the connector 60. In addition, the third sidewall 308 may prevent the chip card 40 from separating from the receiving portion 20. Thus, the chip card 40 is stably received in the receiving portion 20.

When removing the chip card 40, the chip card 40 is pressed via the aperture 3020 of the locking member 30, and is pushed toward the opening 206. When the chip card 40 is exposed out of the receiving portion 20, a user can pull the chip card 40 out of the receiving portion 20 completely by holding the chip card 40. As such, the chip card 40 can be removed from the housing 10.

The locking member 30 is fixedly secured on the housing 10, the present chip card 40 can avoid becoming separated from the receiving portion 20 when the mobile phone 200 falls to ground. The chip card retaining mechanism includes only two simple elements, i.e. the housing 10, and the locking member 30. Thus, the chip card retaining mechanism is quite simple. In addition, the locking member 30 is thin and as a result the chip card retaining mechanism does not occupy much space.

In alternative embodiments, the number of protruding posts 202, 204 can be greater, and also can be of other shape. Also, the protruding posts 202, 204 can be omitted. The ears 3042, the bent portion 3060 and the mounting holes 3042, 3062 can be omitted. That is, the locking member 30 may be secured on the partition 12 of the housing 10 by other means. For example, the locking member 30 may be integrally formed with the housing 10 on the partition 12 to form the receiving portion 20. Also, the locking member may be secured on the partition 12 of the housing 10 using adhesive means such as glue.

In further alternative embodiment, the receiving portion may be a receiving cavity. The locking member 30 is securely mounted on the housing 10, the locking member and a surface of the housing cooperatively forms the receiving cavity therebetween for receiving the chip card therein and locking the chip card in the receiving cavity.

It is believed that the embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A chip card retaining mechanism for retaining a chip card mounted in an electronic device, the electronic device including a housing, the chip card retaining mechanism comprising:

a locking member configured for being securely mounted on the housing before locking the chip card, the locking member and a surface of the housing cooperatively forming a receiving cavity therebetween for receiving the chip card therein, a sidewall of the locking member and the surface of the housing cooperatively forming an opening configured for facilitating an insertion of the chip card into the receiving cavity; and a connector having elastic contacts configured for elastically abutting against the chip card in a manner such that the sidewall of the locking member resists the chip card so as to lock the chip card in the receiving cavity.

2. The chip card retaining mechanism as claimed in claim 1, wherein the locking member includes a substantially rectangular body, and the rectangular body defines an aperture configured for exposing the chip card and facilitating pressing the chip card when the chip card is removed from the receiving cavity.

3. The chip card retaining mechanism as claimed in claim 2, wherein the housing has a plurality of first protruding posts on the surface surrounding the receiving cavity, and the locking member defines a plurality of first mounting holes in two opposite side portions of the rectangular body, the first mounting holes engaging around the first protruding posts.

4. The chip card retaining mechanism as claimed in claim 3, wherein the housing has a second protruding post on the surface adjacent to the receiving cavity, and the locking member defines a second mounting hole corresponding to the second protruding post, the second mounting hole engaging around the second protruding post.

5. The chip card retaining mechanism as claimed in claim 3, wherein the two opposite side portions are two opposite first sidewalls vertically extending from two opposite long sides of the rectangular body, two ends of each first sidewall are provided with an ear horizontally extending therefrom, the first mounting holes are defined in the ears.

6. The chip card retaining mechanism as claimed in claim 3, wherein the locking member further comprises a second sidewall and a bent portion, the second sidewall vertically extending from one side of the rectangular body, the second sidewall being located opposite to the sidewall of the rectangular body, the bent portion horizontally extending from the second sidewall and defining the second mounting hole.

7. The chip card retaining mechanism as claimed in claim 1, wherein the locking member comprises a rectangular body, and the sidewall is hook shaped and extends vertically from one end of the rectangular body.

8. The chip card retaining mechanism as claimed in claim 1, wherein the elastic contacts are exposed out of the surface of the housing.

9. A chip card retaining mechanism for retaining a chip card mounted in an electronic device, the electronic device including a housing, the chip card retaining mechanism comprising:

a receiving portion formed on the housing for receiving the chip card therein, the receiving portion being formed by a bottom surface of the receiving portion, four symmetrical first protruding posts and a second protruding post being defined on the bottom surface of the receiving portion;

a locking member securely mounted on the housing and spanning on the receiving portion, the locking member and the housing together being configured for facilitating an insertion of the chip card into the receiving portion; and a connector having a plurality of elastic contacts exposed out of a bottom surface of the receiving portion;

wherein when the chip card is inserted completely into the receiving portion, and the elastic contacts elastically abut against the chip card in a manner such that the locking member locks the chip card in the receiving portion.

10. The chip card retaining mechanism as claimed in claim 9, wherein the locking member includes a substantially rectangular body, and the rectangular body defines an aperture configured for exposing the chip card and facilitating pressing the chip card when the chip card is removed from the receiving cavity.

11. The chip card retaining mechanism as claimed in claim 10, wherein the locking member comprises two opposite first sidewalls vertically extending from two opposite long sides of the rectangular body, a second sidewall vertically extending from one short side of the rectangular body, and a third sidewall vertically extending from the other short side of the rectangular body.

12. The chip card retaining mechanism as claimed in claim 11, wherein the first sidewalls and the second sidewall are secured on the housing.

13. The chip card retaining mechanism as claimed in claim 12, wherein two ends of each first sidewalls are each provided with an ear horizontally extending therefrom, wherein each ear defines a first mounting hole, for engaging around the first protruding posts, and a bent portion horizontally extending from the second sidewall and defining a second mounting hole, for engaging around the second protruding post.

14. The chip card retaining mechanism as claimed in claim 11, wherein an opening is defined between the third sidewall and the surface of the housing, the opening being configured for facilitating insertion of the chip card into the receiving portion.

15. The chip card retaining mechanism as claimed in claim 11, wherein the third sidewall is hook shaped.

16. An electronic device comprising:

a housing having a receiving portion formed thereon, the receiving portion being formed by the bottom surface of the receiving portion, four symmetrical first protruding posts and a second protruding post being defined on the bottom surface of the receiving portion;

a chip card retaining mechanism comprising:

a locking member securely mounted on the receiving portion and locking the chip card in the receiving portion, a first end of the locking member and a bottom surface of the receiving portion cooperatively forming an opening for inserting the chip card.

17. The chip card retaining mechanism as claimed in claim 16, wherein the locking member comprises a sidewall vertically extending from the first end thereof for abutting a first end of the chip card.

18. The chip card retaining mechanism as claimed in claim 17, wherein the locking member further comprises an opposite end for abutting an opposite second end of the chip card.

* * * * *